US005420384A

United States Patent [19]

Okutomi et al.

[11] Patent Number: 5,420,384

[45] Date of Patent: May 30, 1995

[54] CONTACT MATERIAL FOR A VACUUM INTERRUPTER

[75] Inventors: Tsutomu Okutomi, Yokohama; Atsushi Yamamoto, Hino; Tsuneyo Seki, Fuchu; Mikio Okawa, Tama; Mitsutaka Honma, Tokorozawa, all of Japan

[73] Assignee: Kabushiki Kaisha Toshiba, Kawasaki, Japan

[21] Appl. No.: 214,016

[22] Filed: Mar. 15, 1994

Related U.S. Application Data

[63] Continuation of Ser. No. 796,582, Nov. 22, 1991, abandoned.

[30] Foreign Application Priority Data

Nov. 28, 1990 [JP] Japan ..... 2-327555

[51] Int. Cl.[6] ..... H01H 33/00; H01H 1/02

[52] U.S. Cl. ..... 218/68; 200/264; 200/266

[58] Field of Search ..... 200/144 B, 239, 262, 200/264–266

[56] References Cited

U.S. PATENT DOCUMENTS

| | | | |
|---|---|---|---|
| 2,975,256 | 3/1961 | Lee et al. | 200/144 |
| 3,246,979 | 4/1966 | Lafferty et al. | 75/134 |
| 3,683,138 | 8/1972 | Nabae et al. . | |
| 3,807,965 | 4/1974 | Tazaki et al. | 29/182.1 |
| 5,045,281 | 9/1991 | Okutomi | 420/497 |

FOREIGN PATENT DOCUMENTS

| | | | |
|---|---|---|---|
| 0011044 | 5/1980 | European Pat. Off. | H01H 1/02 |
| 0354997 | 2/1990 | European Pat. Off. | H01H 1/02 |
| 0385380 | 9/1990 | European Pat. Off. | H01H 1/02 |
| 62-077439 | 4/1987 | Japan | C22C 29/06 |

*Primary Examiner*—A. D. Pellinen
*Assistant Examiner*—Michael A. Friedhofer
*Attorney, Agent, or Firm*—Foley & Lardner

[57] ABSTRACT

A contact material for a vacuum interrupter includes: (a) from 25 to 70% by volume of a highly conductive component selected from the group consisting of Ag, Cu and combinations thereof, and (b) from 30 to 75% by volume of an arc-proof component comprising a carbide of an element selected from the group consisting of Ti, Zr, Hf, V, Nb, Ta, Cr, Mo, W and combinations thereof, wherein the average grain size of the said arc-proof component is from 0.3 to 3 micrometers and the average grain distance of the arc-proof component is within the range of 0.1 to 1 micrometer. Contacts for a vacuum interrupter obtained from the contact material have improved wear resistance, large current interruption characteristic, wear resistance, and chopping characteristic, and low temperature rise characteristic.

3 Claims, 1 Drawing Sheet

CONTACT MATERIAL FOR A VACUUM INTERRUPTER

This application is a continuation of application Ser. No. 07/796,582, filed No. 22, 1991, now abandoned.

BACKGROUND OF THE INVENTION

This invention relates to a vacuum interrupter, a vacuum circuit breaker or a vacuum circuit interrupter, and, more particularly, to a contact material for a vacuum interrupter having improved wear resistance characteristic and large current interruption characteristic.

Contacts for a vacuum interrupter for carrying out large current interruption or rated current make and break in a high vacuum utilizing an arc diffusion property in a vacuum, are constituted of two opposing contacts, i.e., stationary and movable contacts.

Principal characteristics required for such contacts for the vacuum interrupter are as follows:

(1) the welding resistance is good during the current interruption or make-and-break process;

(2) the current interruption characteristic-is good; and (3) the voltage withstanding capability is good.

These have been regarded as most fundamental three requirements in the prior art. Versatile studies such as studies of new alloy systems, studies of electrode structures and studies of mechanisms have been carried out and such fundamental three requirements have been dramatically improved. Important requirements other than these three requirements are low and stable temperature rise, low and stable contact resistance, good wear resistance and low and stable chopping current values. However, these requirements contradict each other and therefore it is impossible to meet all of the requirements by a single metal. Accordingly, in many alloy materials which have been practically used, at least two elements which compensate mutually inadequate performance thereof have been used in combination to develop alloy materials which are suitable for specific uses at a large current, at a high voltage or at other conditions. Alloy materials having excellent characteristics have been developed. However, demand for a contact material for a vacuum interrupter which withstands/higher voltage and larger current have increased, and a contact material for the vacuum interrupter which entirely meets such requirements has not been obtained.

On the other hand, in recent years, the diversification of load proceeds with increasing the severity of use conditions of demanders. As a result, it is necessary to use a vacuum interrupter which maintains the fundamental three requirements described above at constant levels and further which has excellent characteristics (demand in load of applied circuits and apparatuses). Generally, an interrupter having a better rank is selected from series of vacuum interrupters having standard specifications. This results in the use of a large system and the loss of economy. For example, in such a case, the fundamental three requirements described above must be insured and the large current interruption characteristic must be compatible with wear resistance.

In general, the surface of contacts is remarkably impaired when large current interruption is carried out. This leads to the wear of the material. The contact having such a worn surface leads to many secondary disadvantages during the make-and-break process or during the interruption process. Therefore, it is required that the wear (contact erosion) be small whenever a large current is interrupted, i.e., it is required that the large current interruption characteristic be compatible with wear resistance.

A known contact material which meets the fundamental three requirements is a Cu—Bi alloy containing no more than 5% by weight (hereinafter referred to as wt %) of an anti-welding component such as Bi (Japanese Patent Publication No. 12131/1966). This Cu—Bi contact segregates Bi in crystal boundaries and this therefore renders the alloy per se brittle. Thus, a low welding opening force is realized and the alloys have an excellent large current interruption property.

Japanese Patent Publication No. 23751/1969 discloses the use of a Cu—Te alloy as a contact material which is used for a large current. While this alloy alleviates the problems associated with the Cu—Bi alloy, it is more sensitive to an atmosphere as compared with the Cu—Bi alloy. Accordingly, the Cu—Te alloy lacks the stability of contact resistance or the like. Furthermore, although both the contacts formed from the Cu—Te alloy and those from the Cu—Bi alloy have excellent anti-welding properties in common and can be used sufficiently in prior art moderate voltage fields in respect to voltage withstanding capability, it has turned out that they are not necessarily satisfactory in applying to higher voltage fields.

On the other hand, a known contact material for a vacuum interrupter is a Cu—Cr alloy containing Cr. This alloy contact exhibits preferred thermal characteristics of Cr and Cu at a high temperature and therefore it has excellent characteristics with respect to high voltage withstanding capability and large current interruption characteristic. That is, the Cu—Cr alloy is widely used as a contact wherein high voltage withstanding characteristic is compatible with large capacity interruption characteristic. However, the Cu—Cr alloy exhibits greatly inferior welding resistance characteristics as compared to the Cu—Bi contact containing no more than about 5% of Bi which has been generally utilized as a contact material for an interrupter. Accordingly, operation mechanism by which a vacuum interrupter formed by using a contact of a Cu—Cr alloy is driven requires a larger opening force as compared with the vacuum interrupter formed by using the Cu—Bi alloy contact, and therefore the vacuum interrupter formed by using the Cu—Cr alloy contact is disadvantageous in with respect to miniaturization and economy.

A Cu—Cr—Bi alloy obtained by adding an anti-welding metal such as Bi or Te to a Cu—Cr alloy is known. The welding resistance of the material is remarkably improved by this alloy. However, the amount of Bi evaporated can vary depending upon conditions used during heat treatments such as baking and brazing, and therefore scattering can occur in respects of large current interruption characteristics and wear resistance. When the current of an inductive circuit such as a motor load is interrupted by means of the conventional vacuum interrupter which does not pay due regard to a surge during the make and break process, an excessive abnormal surge voltage is generated and the load instrument tends to break.

The reasons why such an abnormal surge voltage is generated are attributable to phenomena such as the chopping phenomenon generated when a small current is interrupted in a vacuum (a current interruption is forcedly carried out before the waveform of an alternating current reaches the natural zero point) and a high-frequency arc-extinguishing phenomenon.

The value Vs of the abnormal surge voltage due to the chopping phenomenon is expressed by a product of the surge impedance Zo of a circuit and the current chopping value Ic, i.e., Vs=Zo.Ic. Accordingly, in order to reduce the abnormal surge voltage Vs, the current chopping value Ic must be decreased.

In order to meet the requirements described above, there have been developed vacuum switches wherein contacts composed of tungsten carbide (WC)-silver (Ag) alloys are used (Japanese Patent Application No. 68447/1967 and U.S. Pat. No. 3,683,138). Such vacuum switches have been put to practical use.

The contacts composed of such Ag—WC alloys have the following advantages:

(1) the presence of WC facilitates electron emission;

(2) the evaporation of the contact forming material is accelerated by heating of the surface of electrodes due to collision of field emission electrons; and (3) the contacts exhibit a low chopping current characteristic which is excellent, e.g., for remaining an arc by decomposing a carbide of the contact material by the arc and forming a charged particle.

Another contact material exhibiting a low chopping current characteristic is an Ag—Cu—WC alloy wherein the ratio of Ag to Cu is approximately 7:3 (Japanese Patent Application No. 39851/1982). In this alloy, the ratio of Ag to Cu which has not been used in the prior art is selected and therefore it is said that stable chopping current characteristic is obtained.

Furthermore, Japanese Patent Application No. 216648/1985 suggests that the grain size of an arc-proofing material (e.g., the grain size of WC) of from 0.2 to 1 micrometer is effective for improving the low chopping current characteristic.

Further, Japanese Patent Laid-Open Publication No. 35174/1978 discloses a Cu—WC—Bi—W alloy wherein the welding resistance of the sintered alloy described above is highly improved.

It is important that the contact material for a vacuum interrupter meets the fundamental three requirements described above and further requirements emphasized by demanders (wear resistance). However, these requirements contradict each other and therefore it is impossible to meet all of the requirements by a single metal material. Accordingly, in many contact materials which have been practically used, at least two elements which compensate mutually inadequate performance thereof have been used in combination to develop contact materials which are suitable for specific uses at a large current, at a high voltage or at other conditions. Contact materials having excellent characteristics have been developed. However, demands for a contact material for a vacuum interrupter which has high reliability have increased, and a contact material for the vacuum interrupter which entirely meets such requirements has not been obtained.

That is, a highly boiling component is advantageous for providing arc-proof property which is relevant with wear resistance. However, the high boiling component exhibits high temperatures when it is exposed to an arc. Accordingly, thermal electron emission is remarkable. Thus, the highly boiling component is disadvantageous and large current interruption cannot be maintained and improved.

In the Cu—Bi contact material described above, the brittleness of a stock is utilized to insure welding resistance. Accordingly, the Cu—Bi contact material has a fatal drawback in respect of wear resistance, surface roughening occurs during the current interruption or make-and-break process and thus the contact resistance characteristic exhibits large scattering.

In the prior art conventional Ag—WC contact material, Ag is selectively evaporated in a relatively early period as the number of current interruption or make and break increases. Thus, portions containing no Ag are locally generated to lead to the increase of contact wear. That is, in the prior art contact composed of WC and Ag, the large current interruption characteristic can be improved by adjusting the amount of WC. However, the amount Ag can relatively vary and therefore wear resistance characteristic changes. Accordingly, it is necessary to make various improvements in order to obtain lower and stable both characteristics even at the same amount of Ag.

In the contacts composed of the WC—Ag alloys (Japanese Patent Application No. 68447/1967 and U.S. Pat. No. 3,683,138), the large current interruption characteristic per se is insufficient, and no regard is paid to the improvement of wear resistance characteristic.

In the Ag—Cu—WC alloys wherein the weight ratio of Ag to Cu is approximately 7:3 (Japanese Patent Application No. 39851/1982) and the alloys wherein the grain size of the arc-proofing material is from 0.2 to 1 micrometer (Japanese Patent Application No. 216648/1985), their wear resistance characteristic is not entirely satisfactory.

In the Cu—WC—Bi—W contact materials, the welding resistance of the Cu—W contacts is improved by a synergistic effect of the presence WC and particularly Bi. However, the scattering of wear resistance characteristic is still observed.

An object of the present invention is to provide a contact material for a vacuum interrupter which combines excellent large current interruption characteristic and wear resistance characteristic and which meets the requirement for the vacuum interrupter to be used under severe conditions.

SUMMARY OF THE INVENTION

We have now found that for alloy systems composed of a highly conductive component and an arc-proof component, if their ratios are optimized, particularly if the grain size of the arc-proof component and the average grain distance of the arc-proof grains which are present in the alloy are optimized to specific values, then the object of the present invention is effectively achieved.

A contact material used in a vacuum interrupter of the present invention is an Ag— or Ag—Cu—metal carbide (for convenience, an arc-proof component is sometimes represented by WC) contact material for a vacuum interrupter comprising a highly conductive component selected from Ag and/or Cu, and an arc-proof component such as WC, wherein (1) the content of the highly conductive component (the total amount of Ag and Cu) is from 25 to 70 vol %;

(2) the contact of the arc-proof component is from to 75 vol % wherein said component is at least one carbide of an element selected from the group consisting of Ti, Zr, Hf, V, Nb, Ta, Cr, Mo and W; and (3) the arc-proof component having an average grain size of 0.3 to 3 micrometers is present at an average grain distance of from 0.1 to 1 micrometer. In a preferred embodiment of the present invention, an auxiliary component selected from Fe, Co and Ni can be present in an amount of no more than 10 vol %.

DETAILED DESCRIPTION OF THE INVENTION

Figure 1:
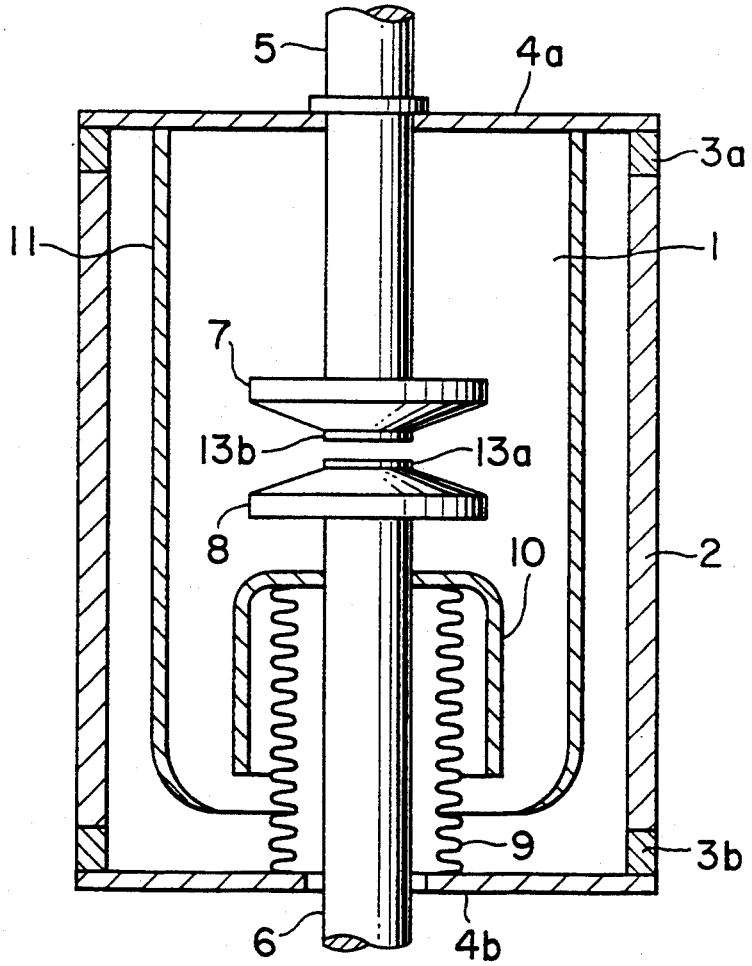
FIG. 1 is a sectional view of a vacuum interrupter to which a contact material for the vacuum interrupter according to the present invention is applied.

While the present invention will be described with respect to a contact material wherein a highly conductive component is Ag and an arc-proof component is represented by WC, it is not limited thereto.

In order to simultaneously improve the large current interruption characteristic and wear resistance characteristic of an Ag—WC contact material, it is important that the combination of the amount of Ag (i.e., a highly conductive component); in the contact material and the presence form, of WC in the contact material, (i.e., the average grain) distance and grain size of WC grains be controlled to preferred ranges, particularly it is extremely important that the interruption current value per se is maintained at a larger value, that its scattering width is reduced, that the wear amount is inhibited to the specific ranges, and that the change associated with lapse of make-and-break process (increase of wear) is avoided. The large current interruption characteristic described above is concerned with the amount of a vapor between contacts (vapor pressure and heat conduction in terms of the physical properties of the material) and electrons emitted from the contact material. Accordingly, it is important that contacts are self-controlled in such a state that the amount of vapor released at a space between electrodes during the interruption process is just enough. The self-control becomes possible by simultaneous control of the grain size of WC and the average grain distance of That is, in the Ag and arc-proof material type alloy represented by Ag—WC, the following drawbacks can occur. While the resulting results are influenced by the amount of an Ag vapor at the boiling point of the arc-proof material (in this case, WC), the vapor pressure of Ag is remarkably lower than that of Bi in the Cu—Bi system described above and therefore this leads to temperature fluctuation, i.e., vapor amount fluctuation depending upon the member of a contact (Ag or the arc-proof material) to which the cathode spot is secured. Eventually, it has been confirmed that the scattering becomes apparent. It has been thought that it is difficult to control the drastic change in temperature at the surfaces of a contact during the current interruption process, by using the prior art alloy composed of a combination of Ag with an arc-proof material and to maintain an arc. It has been concluded that it is necessary to use auxiliary techniques in order to obtain higher performance. The Japanese Patent Application No. 39851/1982 described above discloses an improved process. This Japanese Patent Application suggests a technique wherein crystal grains are finely distributed by using an Ag—Cu alloy as a highly conductive component. According to this technique, the characteristics of the product are drastically stabilized. The situation to which an arc is principally secured is an arc-proof component or an Ag—Cu alloy. In any case, feed of an Ag—Cu vapor is controlled to improve the interruption current characteristic. However, some scattering can generate when the arc is secured to the arc-proof component.

On the other hand, the scattering width is improved by refining the arc-proof component. Accordingly, this suggests that the grain size of the arc-proof component plays an important role in the large current interruption characteristic and suggests that the grain size in the specific range should be used by considering the observation results showing remarkable scattering in the case of a contact material wherein segregation is observed (the size of the arc-proof component is from about 10 to about 20 times its initial grain size).

While its chopping current characteristic is improved by controlling the amounts of Ag and Cu and the grain size of WC to specific values as described in Japanese Patent Application No. 39851/1982, the technique described therein neither provides improved large current interruption characteristic, nor ensures lower and stable wear resistance characteristic.

As described above, the refinement and uniformity of the contact texture are achieved by utilization of fine WC powder, utilization of the specific amount of Ag and utilization of the preferred state of WC powder (average grain distance). Accordingly, the contact material of the present invention exhibits stable large current interruption characteristic and wear resistance characteristic. The amount of Ag evaporated by Joule heat and arc heat during the make-and-break process is controlled even after multiple make-and-break processes and the present contact material exhibits stable large current interruption characteristic.

In order to improve the states described above, the average grain size of the arc-proof component (WC) is set at specific preferred ranges and the average grain distance of WC grains is set at specific ranges to control the evaporated amount of the highly conductive component (Ag) which governs large current interruption characteristic.

Thus, the evaporation state of the Ag component can be controlled without impairing wear resistance. Eventually, the large current interruption performance is stabilized.

If the average grain size of the WC component is larger than 3 micrometers (e.g., experiment was carried out by using the WC component having an average grain size of 6 to 44 micrometers), the large-current interruption characteristic will be reduced even if the average grain distance of WC grains is within the range of specific values, i.e., within the range of 0.1 to 1 micrometer (Comparative Example A5). If the average grain size of the WC component is smaller than 0.3 micrometers, cracks will be observed in the surface of contacts and the stability of wear resistance characteristic will be impaired even if the average grain distance of the WC component is within the range of 0.1 to 1 micrometer. In the case of the same amount of WC, if the average grain distance of WC is smaller (smaller than 0.1 micrometer), the evaporation and feed of Ag to a space between electrodes during the interruption process tend to increase, and therefore the large current interruption characteristic is deteriorated.

When the grain size of WC is within the specific values of 0.3 to 3 micrometers, both the large current interruption characteristic and the wear resistance can be obtained at certain levels. When the average grain distance of WC grains also is within specific values, the scattering width of both characteristics is remarkably small, these characteristics are improved and their stability is improved.

In order to improve both large current interruption characteristic and wear resistance characteristic, it is essential in the present invention that the arc-proof component having an average grain size of 0.3 to 3 micrometers be present, while keeping the average intergranular distance at from 0.1 to 1 micrometer, in the case of the contact material comprising the highly conductive component and the arc-proof component wherein the highly conductive component is Ag and/or Cu in an amount of 25 to 70 vol % and the arc-proof component is at least one carbide of an element selected from Ti, Zr, Hf, V, Nb, Ta, Cr, Mo, and W.

Thereby, the amount of the highly conductive component released to a space between electrodes during the interruption process which governs large current interruption characteristic is self-controlled to ranges which adversely affect current interruption, and, at the same time, the contact wear or contact erosion is reduced.

In the case of the same amount of WC, WC having a smaller (finer) grain size provides the increased temperature rise of the arc spot portions or their peripheral microfine portions (the temperature is raised) when the same thermal input (e.g., arc during the interruption process) is applied. If the average grain distance of WC is smaller to a certain extent, the temperature rise is synergistically increased to induce the excess evaporation and wear of Ag (highly conductive component) which surrounds these WC grains.

If the average grain distance of WC is larger to a certain extent, the arc spots tend to be divided into a WC portion and an Ag portion and the scattering width of characteristics will be increased.

Because of such phenomena, it is necessary that the selection of the adequate values of the grain size of WC and the selection of the preferred ranges of the average grain distance of WC be simultaneously met.

The present invention will now be described with reference to attached drawings.

Figure 2:
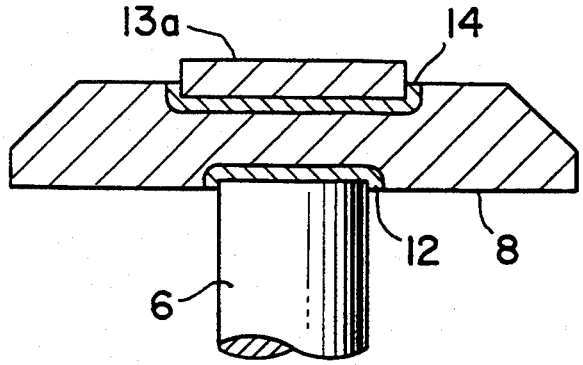
FIG. 2 is an enlarged sectional view of the electrode portion of the vacuum interrupter shown in FIG. 1.

FIG. 1 is a sectional view of a vacuum interrupter and FIG. 2 is an enlarged sectional view of the electrode portion of the vacuum interrupter.

In FIG. 1, reference numeral 1 shows an interruption chamber. This interruption chamber 1 is rendered vacuum-tight by means of a substantially tubular insulating vessel 2 of an insulating material and metallic caps 4*a* and 4*b* disposed at its two ends via sealing metal fittings 3*a* and 3*b*.

A pair of electrodes 7 and 8 fitted at the opposed ends of conductive rods 5 and 6 are disposed in the interruption chamber 1 described above. The upper electrode 7 is a stationary electrode, and the lower electrode 8 is a movable electrode. The electrode rod 6 of the movable electrode 8 is provided with bellows 9, thereby enabling axial movement of the electrode 8 while retaining the interruption chamber 1 vacuum-tight. The upper portion of the bellows 9 is provided with a metallic arc shield 10 to prevent the bellows 9 from becoming covered with arc and metal vapor. Reference numeral 11 designates a metallic arc shield disposed in the interruption chamber 1 so that the metallic arc shield covers the electrodes 7 and 8 described above. This prevents the insulating vessel 2 from becoming covered with the arc and metal vapor. As shown in FIG. 2 which is an enlarged view, the electrode 8 is fixed to the conductive rod 6 by means of a brazed portion 12, or pressure connected by means of a caulking. A contact 13*a* is secured to the electrode 8 by brazing as at 14. A contact 13*b* is secured to the electrode 7 by brazing.

One example of a process for producing the contact-forming material will be described. Prior to production, the arc-proof component and the auxiliary components are classified on a necessary grain size basis. For example, the classification operation is carried out by using a sieving process in combination with a settling process to easily obtain a powder having a specific grain size. First, the specific amounts of WC having a specific grain size, and a portion of the specific amount of Ag having a specific grain size are provided, mixed and thereafter pressure molded to obtain a powder molded product.

The powder molded product is then presintered in a hydrogen atmosphere having a dew point of no more than −50° C. or under a vacuum of no more than $1.3\times10^{-1}$ Pa at a specific temperature, for example 1,150° C. (for one hour) to obtain a presintered body.

The specific amount of Ag is then infiltrated into the remaining pores of the presintered body for one hour at a temperature of 1,150° C. to obtain an Ag—WC alloy. While the infiltration is principally carried out in a vacuum, it can also be carried out in hydrogen.

One example of a process for adjusting the average grain distance of a WC grain in a contact during the contact production process is described. The average grain distance of WC in an alloy of the present invention can vary depending upon the state of the powder such as the shape of the WC grain, the state of surface contamination of WC powder, the grain size of the WC grain, the grain size distribution of the WC grain, and the type and amount of impurities in the WC grain. The average grain distance of WC is also correlated with the presence of sintering aids, the period of time for mixing with the highly conductive material, the presence of a lubricant, forming pressure, sintering temperature and optionally infiltration temperature.

For example, 600 grams of a WC powder having an average grain size of 0.7 micrometers, 600 grams of an Ag powder having an average grain size of 5 micrometers and 10.5 grams of a Co powder having an average grain size of 5 micrometers as a sintering aid were mixed in a ball mill for 2 hours, the resulting mixture was formed into a formed product under a specific forming pressure, the formed product was sintered in a controlled atmosphere to obtain a sintered body, Ag was infiltrated into the vacancy remaining in the sintered body at a temperature of 1,050° C. to obtain a 40% WC-59.3% Ag-0.7% Co alloy wherein the average grain distance of a WC grain in said alloy was 0.3 micrometers. An Ag—WC alloy having another average grain distance is obtained by the combination of the control of powder state, the control of the forming pressure and the control of sintering temperature.

These experiments are carried out by using WC having another grain size to obtain alloys having the specific average grain distance of WC. The conditions described above can vary depending upon the grain size of WC.

A method of evaluating data obtained in Examples of the present invention and the evaluation conditions are described below.

1. Large Current Interruption Characteristic

A flat electrode having a degree of surface roughness of 5 micrometers and a convex electrode having a curvature radius of 100 R and having the same degree of surface roughness as that of the flat electrode are opposed. The two electrodes are mounted on an electrode-mountable evacuated (a degree of vacuum of no more than $10^{-3}$ Pa) vacuum vessel having a make-and-break mechanism. A load of 40 kg is applied thereto. A power having 7.2 kV and 31.5 kA is subjected to a make-and-break process. When the make-and-break process is repeated 10 times, whether or not the interruption is possible without welding and without restrike is evaluated. When the generation Of welding or restrike is often observed before the number of make-and-break process reaches 10 times, the test is discontinued.

2. Wear Resistance Characteristic

The same electrodes as described above are opposed as described above. In a vacuum vessel having a degree of vacuum of no more than $10^{-3}$ Pa, a power having 7.2 kV and 4.4 kA is subjected to a make-and-break process 1,000 times. The weight of the electrodes prior to such a treatment and the weight of the electrodes after such a treatment of measured to determine wear. Data are relative values are obtained when the wear amount of Example is expressed as 1.0.

3. Contact under Test

The materials from which the contacts under test are produced and the corresponding data are shown in Table 1.

As shown in Table 1, the amount of Ag (in some cases, an Ag—Cu alloy) in an Ag—WC alloy was varied in the range of 15% to 83% to prepare samples where WC has a specific grain size (WC). Contacts having a specific average grain distance were determined by microscopy or the like. Samples wherein WC has an average grain distance of <0.1 micrometer to 2.2 micrometers were selected. These contacts are obtained by principally the control of forming pressure, sintering temperature and preliminary agent amounts (a portion of Ag is previously mixed in WC and the resulting mixture is formed into a desired shape) as described above.

Further, the type of the arc-proof component used was varied to evaluate the properties of products.

EXAMPLES A1 THROUGH A3 AND COMPARATIVE EXAMPLES A1 AND A2

A WC powder having an average grain size of about 0.1 micrometer and four WC powders having an average grain size of 0.3 to 6 micrometers (the WC powder having an average grain size of 0.1 micrometer is obtained by collecting fines from powder having an average grain size of 0.3 micrometers) and an Ag powder having an average grain size of 5 micrometers are provided.

The Ag and WC powders were mixed at a specific ratio, and thereafter, formed while suitably selecting the forming pressure in the range of zero to 8 metric tons per square centimeter so that the amount of the remaining pore present in a skeleton after sintering is adjusted. In a certain case, a skeleton composed of only WC was prepared and the operation similar to that described above was carried out.

There were prepared contacts wherein the final amount of Ag is from 34 to 35 vol %. These contacts were tested for large current interruption characteristic and wear resistance according to the evaluation methods described above.

As can be seen from Table 1, in the case of the contact wherein the grain size of WC is 0.1 micrometer and the average grain distance of WC is <0.1 micrometer, the contact exhibited interruption inability after several make-and-break processes in the interruption test, and the loss of the material after interruption 1,000 times at 4.4 kA was large (Comparative Example A1).

On the contrary, in the cases of the contacts wherein the grain size of WC was from 0.3 to 3 micrometers and the average grain distance of WC was from 0.1 to 1 micrometer, a current having 31.5 kA was successfully interrupted 10 times and the wear resistance was stable (Example A1 through A3).

In the case of the contact wherein the grain size of WC was 6 micrometers and the average grain distance was larger, sufficient interruption performance and wear resistance characteristic were not obtained (Comparative Example A2).

It has turned out that the grain size of WC is preferably within the range of 0.3 to 3 micrometers and the average grain distance is preferably within the range of 0.1 to 1.0 micrometer.

EXAMPLES A4 THROUGH A7 AND COMPARATIVE EXAMPLES A3 THROUGH A6

In the case of a sample wherein the average grain distance is 0.08 micrometers and thus outside the preferred ranges (the average grain distance of a WC grain being from 0.1 to 1 micrometer) even if the grain size of WC is 0.7 micrometers and thus within the preferred ranges described above (the grain size of WC being from 0.3 to 3 micrometers) (Comparative Example A3), as can be seen from Table 1, both large current interruption characteristic and wear resistance are poor. In the case of a sample wherein the average grain distance of a WC grain is 2.2 micrometers and thus outside the preferred range (Comparative Example A4), both characteristics are poor. The generation of partial welding was observed (Comparative Example A4).

In the case of a sample wherein the grain size of WC is 6 micrometers (outside the preferred range) even if the average grain distance of WC is 0.3 micrometers and thus within the preferred range, both characteristics are poor (Comparative Example A5).

As can be seen from the results described above, good characteristics are obtained when the amount of Ag in the samples (i.e., the amount of the highly conductive component) is within the range of 25 vol % to 70 vol % as described in Examples A1, A2, A3, A4, A5 and A6. In the case of the sample wherein the amount of Ag is smaller, i.e., from 15 to 16 vol % (Comparative Example A3), all of interruption tests (10 times) exhibited interruption inability. In the case of the sample wherein the amount of Ag is larger, i.e., from 82 to 83 vol % (Comparative Example A4), its wear resistance is remarkably inferior.

While the highly conductive component described above is Ag, Ag—Cu can be used as the highly conductive component. In the case of Ag—Cu, both characteristics are good because the grain size and average grain distance of WC are within specific ranges (Example A7). In Example A7, the percentage of Cu based on the total amount of Ag and Cu was 60 vol %. If the percentage of Cu is 80 vol %, its contact resistance exhibited scattering and tended to be increased. In this case, the test was discontinued (Comparative Example A6).

EXAMPLES A8 THROUGH A21

The arc-proof component used in all of Examples A1 through A7 and Comparative Examples A1 through A6 described above was WC. When the average grain size and average grain distance of the arc-proof component are within the specific ranges described above, similar good results were obtained using arc-proof components other than WC, i.e., TiC, ZrC, HfC, VC, NbC, TaC, $Cr_3C_2$ and $Mo_2C$ (Examples A8 through A15).

Good results were obtained by controlling the grain size and average grain distance of the arc-proof component to specific ranges as described above even if the arc-proof component is a plurality of species (e.g., WC-$Mo_2C$) rather than one species (Example A16). While Ni, Co or Fe was added as an auxiliary component in these Examples A8 through A21, similar good results were obtained.

When the amount of the auxiliary component was up to 10 vol %, good results were obtained (Example A17).

TABLE 1

| | Contact Material under Test | | | | | | | | Evaluation Result | | |
|---|---|---|---|---|---|---|---|---|---|---|---|
| | Highly Conductive Component | | Arc-proof component | | 0.3~3 $d_{WC}$ Grain | 0.1~1 λ Average Grain | Auxiliary Component | | Large Current Interruption Test Make-and-break Test of a Power having 7.2 kV | Wear Resistance Test Change in Weight after interrupting a Power having 7.2 kV and 4.4 kA 1,000 Times (Relative Value obtained when the Value of Example 2 is expressed as 1.0) | |
| | Type | Amount (vol %) | Type | Amount (vol %) | Size (μm) | Distance (μm) | Type | Amount (vol %) | and 31.5 kA is to be carried out 10 times | | Remark |
| Comp. Exam. A1 | Ag | 34~35 | WC | 65~66 | 0.1 | <0.1 | | | Interruption is impossible from 5 to 8 times in 10 times | 3.7~7.3 | Surface Cracking |
| Exam. A1 | " | " | " | " | 0.3 | 0.1 | | | Interruption is successfully carried out 10 times | 1.7~2.2 | |
| Exam. A2 | " | " | " | " | 0.7 | 0.24 | | | Interruption is successfully carried out 10 times | 1.0 | |
| Exam. A3 | " | " | " | " | 3 | 1.0 | | | Interruption is successfully carried out 10 times | 0.9~1.1 | |
| Comp. Exam. A2 | " | " | " | " | 6 | 2.1 | | | Interruption is impossible from 2 to 4 times in 10 times | 0.6~0.9 | |
| Comp. Exam. A3 | Ag | 15~16 | WC | 84~85 | 0.7 | 0.08 | | | Interruption is impossible 10 times | 5.3~12.5 | Large evaporation of Ag |
| Exam. A4 | " | 45~46 | " | 54~55 | " | 0.39 | | | Interruption is successfully carried out 10 times | 2.4~4.5 | |
| Exam. A5 | " | 69~70 | " | 30~31 | " | 1.0 | | | Interruption is successfully carried out 10 times | 4.1~7.1 | |
| Comp. Exam. A4 | " | 82~83 | " | 17~18 | " | 2.2 | | | Interruption is impossible one time of 10 times | 11.5-22.2 | Partial welding generation |
| Comp. Exam. A5 | Ag | 7~8 | WC | 92~93 | 6 | 0.3 | | | Fifth to seventh interruption cannot be carried out | 3.8~10.2 | |
| Exam. A6 | " | 25~26 | " | 74~75 | 0.7 | 0.15 | | | Interruption is successfully carried out 10 times | 3.2~6.1 | |
| Exam. A7 | Ag/Cu = 4/6 | 35~36 | " | 64~65 | 0.7 | 0.25 | | | Interruption is successfully | 0.75~1.0 | |

TABLE 1-continued

| | Contact Material under Test | | | | | | | | Evaluation Result | | |
|---|---|---|---|---|---|---|---|---|---|---|---|
| | Highly Conductive Component | | Arc-proof component | | 0.3~3 $d_{WC}$ Grain Size (μm) | 0.1~1 λ Average Grain Distance (μm) | Auxiliary Component | | Large Current Interruption Test Make-and-break Test of a Power having 7.2 kV and 31.5 kA is to be carried out 10 times | Wear Resistance Test Change in Weight after interrupting a Power having 7.2 kV and 4.4 kA 1,000 Times (Relative Value obtained when the Value of Example 2 is expressed as 1.0) | Remark |
| | Type | Amount (vol %) | Type | Amount (vol %) | | | Type | Amount (vol %) | | | |
| | | | | | | | | | carried out 10 times | | |
| Comp. Exam. A6 | Ag/Cu = 2/6 | " | " | " | " | " | | | Interruption is successfully carried out 10 times | Contact Resistance increased and therefore tests were discontinued | |
| Exam. A8 | Ag | 34~35 | TiC | 65~66 | 0.7 | 0.2~0.3 | Ni | 0.7 | Interruption is successfully carried out 10 times | 0.7~0.9 | |
| Exam. A9 | " | " | ZrC | " | " | " | Co | " | Interruption is successfully carried out 10 times | 0.7~0.9 | |
| Exam. A10 | " | " | HfC | " | " | " | Ni | " | Interruption is successfully carried out 10 times | 0.8~0.9 | |
| Exam. A11 | " | " | VC | " | " | " | Ni | " | Interruption is successfully carried out 10 times | 0.7~0.9 | |
| Exam. A12 | " | " | NbC | " | " | " | Co | " | Interruption is successfully carried out 10 times | 0.7~0.9 | |
| Exam. A13 | " | " | TaC | " | " | " | Ni | " | Interruption is successfully carried out 10 times | 0.8~0.9 | |
| Exam. A14 | " | " | $Cr_3C_2$ | " | " | " | Ni | " | Interruption is successfully carried out 10 times | 0.9~1.1 | |
| Exam. A15 | " | " | $Mo_2C$ | " | " | " | Fe | " | Interruption is successfully carried out 10 times | 0.9~1.1 | |
| Exam. A16 | Ag | 34–35 | WC/$Mo_2C$ 8/2 | 65~66 | 0.7 | 0.2~0.3 | Fe | 0.7 | Interruption is successfully carried out 10 times | 0.9~1.1 | |
| Exam. A17 | " | " | WC | " | " | 0.24 | Co | 10 | Interruption is successfully | 0.9~1.1 | |

TABLE 1-continued

| | Contact Material under Test | | | | | | | | Evaluation Result | | |
|---|---|---|---|---|---|---|---|---|---|---|---|
| | Highly Conductive Component | | Arc-proof component | | 0.3~3 $d_{WC}$ Grain | 0.1~1 λ Average Grain | Auxiliary Component | | Large Current Interruption Test Make-and-break Test of a Power having 7.2 kV and 31.5 kA is to be carried out 10 times | Wear Resistance Test Change in Weight after interrupting a Power having 7.2 kV and 4.4 kA 1,000 Times (Relative Value obtained when the Value of Example 2 is expressed as 1.0) | Remark |
| | Type | Amount (vol %) | Type | Amount (vol %) | Size (μm) | Distance (μm) | Type | Amount (vol %) | | | |
| | | | | | | | | | carried out 10 times | | |
| Exam. A18 | " | " | " | " | " | " | " | 3 | Interruption is successfully carried out 10 times | 0.9~1.0 | |
| Exam. A19 | " | " | " | " | " | " | " | 0.7 | Interruption is successfully carried out 10 times | " | |
| Exam. A20 | " | " | " | " | " | " | Fe | " | Interruption is successfully carried out 10 times | " | |
| Exam. A21 | " | " | " | " | " | " | Ni | " | Interruption is successfully carried out 10 times | " | |

As can be seen from Examples A1 through A21, both excellent large current interruption characteristic and excellent wear resistance are obtained by selecting the specific total amount of the highly conductive component selected from Ag and/or Cu, selecting the arc-proof component having an average grain size of 0.3 to 3 micrometers and controlling the average grain distance of the arc-proof component to the range of 0.1 to 1 micrometer.

A low surge property is required for vacuum interrupters, and therefore a low chopping current characteristic (low chopping characteristic) has been required in the prior art.

In recent years, vacuum interrupters have been increasingly applied to inductive circuits such as large capacity motors, and high surge impedance load. Accordingly, vacuum interrupters must combine an even more stable low chopping current characteristic and a satisfactory large current interruption characteristic.

Heretofore, there have been no contact materials which simultaneously satisfy these two characteristics.

In the contacts composed of the WC—Ag alloys (Japanese Patent Application No. 68447/1967 and U.S. Pat. No. 3,683,138), the chopping current value per se is insufficient, and no regard is paid to the improvement of large current interruption characteristic.

In the 10 wt % Bi—Cu alloys (Japanese Patent Publication No. 14974/1960 and U.S. Pat. No. 2,975,256) the amount of a metal vapor fed to the space between the electrodes is reduced as the number of make and break increases. The deterioration of low chopping current characteristic occurs and the deterioration of voltage withstanding characteristic occurs depending upon the amount of an element having a high vapor pressure.

In the 0.5 wt % Bi—Cu alloy (Japanese Patent Publication No. 12131/1966 and U.S. Pat. No. 3,246,979), its low chopping current characteristic is insufficient. In the Ag—Cu—WC alloys wherein the weight ratio of Ag to Cu is approximately 7:3 (Japanese Patent Application No. 39851/1982) and the alloys wherein the grain size of the arc-proofing material is from 0.2 to 1 micrometer (Japanese Patent Application No. 216648/1985), no regard is paid to the improvement of large capacity interruption characteristic. We have now found that Ag—Cu—WC contact materials having improved characteristics can be obtained by setting the composition, texture and relative density of the contact material as described above. That is, a contact material for a vacuum interrupter according to this embodiment is an Ag—Cu—WC—Co contact material for a vacuum interrupter comprising a highly conductive component selected from Ag and/or Cu, a WC arc-proof component and an auxiliary component selected from the group consisting of Co, Fe, Ni and combinations thereof, wherein (A) the composition of the contact material is such a composition that (i) the content of said highly conductive component is from 25 to 65% by volume and the percentage of Ag based on the total amount of the highly conductive component [Ag/(Ag+Cu)×100] is from 40 to 100% by volume, (ii) the content of the auxiliary component is no more than 1% by volume, and (iii) balance is the arc-proof component;

(B) the texture of said contact material is such a texture that (i) a portion or all of said contact material comprises a matrix composed of highly conductive component and a skeleton composed of an arc-proof component having a grain size of no more than 3 micrometers, and balance is only a highly conductive component and it forms a coarse island-shaped texture having at least 5 micrometers, and (ii) the average grain distance of the discontinuous grain of said arc-proof component in the remainder except said island-shaped texture portion (values calculated by the following equation (1)) is from 0.1 to 0.5 micrometers; and (C) the relative density of a contact is at least 90% by volume:

$$\lambda_{WC} = \frac{2}{3} \cdot d_{WC}\left(\frac{f_i}{f_{WC}} - 1\right) \quad (1)$$

wherein $\lambda_{wc}$ is the average grain distance of WC (μm); $d_{WC}$ is the grain size of WC (μm); $f_i$ is % by volume of portions except the island-shaped texture; and $f_{wc}$ is % by volume of WC.

This embodiment will be described.

The minimization of a chopping current value determined by the contact material is a necessary condition for insuring a low surge property. This chopping current value is a value having a statistical distribution and is different from a value of physical property wherein the same value is reproducibly obtained every time. From the industrial standpoint, the value should be evaluated by a maximum value after predetermined times of measurements. In order to reduce the maximum value, it is necessary that the average value of the distribution and its variance be reduced.

In the case of a contact material containing a metal component, a current chopping phenomenon occurs due to the fact that the balance of a charge which maintains an arc discharge (metal ions and electrons) and metal vapors and thermal electrons emitted from the contact material is lost in a cathode spot of an arc immediately before zero of an alternating current by the reduction of input energy due to the reduction of a current. Accordingly, in order to reduce the average value of a chopping current value, it is important that the vapor pressure of a conductive component is high, the thermal conductivity of the whole contact material is low, an input energy from an arc which is reduced with reducing a current is compensated by a regenerative effect of an arc-proof material, and an energy consumed in the evaporation of the necessary amount of a metal vapor is maintained at a level near the current zero. For this purpose, it is preferred that the amount of the arc-proof material be larger than a certain specific amount. In other words, it is preferred that the amount of the conductive component be smaller than a certain specific amount. In the cases of Ag—WC and Ag—Cu—WC contacts, it is preferred that the amount of the conductive component be no more than 65% by volume.

Further, it is preferred that the amount of the sintering auxiliary component such as Co be minimized because the presence of the sintering auxiliary component inhibits chopping characteristic.

The surface of contacts actually moves and therefore a cathode spot of an arc exhibits the increased variance of a chopping current value when the texture of the contact material is ununiform. In the cases of Ag—WC and Ag—Cu—WC contacts, it is necessary that the grain size of WC be no more than 3 micrometers in order to minimize the variance of a chopping current value.

On the other hand, in order to render large current interruption possible, it is required that the density of a metal vapor generated during the current interruption process be lowered and the recovery of insulation after interruption be facilitated. However, in the cases of Ag—WC and Ag—Cu—WC contacts, the amount of a metal vapor emitted from the cathode spot must be large from the standpoint of a low surge property (low chopping current characteristic). Accordingly, in order to reduce the density of a metal vapor, the cathode spot of the arc must be smoothly diffused onto the surface of the contacts and the density of the cathode spot must be reduced. The emission of a metal vapor is largest in a WC/Ag interface, and therefore it can be thought that the grain distance of WC is preferably narrow in order to smoothly move the cathode spot of the arc. However, if a contact material having an extremely small grain distance is to be prepared, the grain growth or agglomeration of WC will occur and in turn the grain distance will be increased. Accordingly, in order to minimize the average grain distance of WC in a material prepared, it is preferred that the average grain distance calculated by the above equation (1) from the composition of the contact material and the grain size of WC be from 0.1 to 0.5 micrometers.

If the amount of the conductive component is less than 25% by volume in the cases of Ag—WC and Ag—Cu—WC contacts, the conductivity will be remarkably reduced and therefore it is difficult to pass a large current.

Further, if the relative density of the contact material is lower, a gas occluded in pores or an adsorbed gas will be released during the large current discharge process and breakdown will occur due to the reduction of a degree of vacuum. Accordingly, it is difficult to interrupt a large current.

As stated above, low chopping current characteristic and large current interruption characteristic can be combined by observing the proper amount of the conductive component, the sufficiently small content of Co, the sufficiently fine grain size of WC, the appropriate average grain distance of WC (calculated values), and the sufficiently high relative density of the contacts.

One example of a process for producing the contact material of the embodiment described above will be described. Prior to production, the arc-proof component and the auxiliary components are classified on a necessary grain size basis. For example, the classification operation is carried out by using a sieving process in combination with a settling process to easily obtain a powder having a specific grain size. First, the specific amounts of WC having a specific grain size, Co and/or C and a portion of the specific amount of Ag having a specific grain size are provided, mixed and thereafter pressure molded to obtain a powder molded product.

The powder molded product is then presintered in a hydrogen atmosphere having a dew point of no more than −50° C. or under a vacuum of no more than $1.3\times10^{-1}$ Pa at a specific temperature, for example 1,150° C. (for one hour) to obtain a presintered body.

The specific amount of Ag—Cu having a specific ratio is then infiltrated into the remaining vacancy of the presintered body for one hour at a temperature of 1,150° C. to obtain an Ag—Cu—Co—WC alloy. While the infiltration is principally carried out in a vacuum, it can also be carried out in hydrogen.

The control of the ratio Ag/(Ag+Cu) of the conductive components in the alloy was carried out as follows: For example, an ingot previously having a specific ratio Ag/(Ag+Cu) was subjected to vacuum melting at a temperature of 1,200° C. under a vacuum of $1.3\times10^{-2}$ Pa and the resulting product was cut and used as a stock for infiltration. Another process for controlling the ratio Ag/(Ag+Cu) of the conductive components can be carried out by previously mixing a portion of the specific amounts of Ag or Ag+Cu in WC in order to make a presintered body. Thus, a contact alloy having a desired composition can be obtained.

The average grain distance of WC is controlled by adjusting the total amount of the conductive components, the amount of the conductive components preliminarily blended into WC during the presintering process (the proportion of the conductive components introduced into the material by preliminarily blending into WC during the presintering process based on the total amount of the conductive components is hereinafter referred to as "percent preliminary blending"), the grain size of WC and the content of Co. The average grain distance of WC as used herein is a value obtained according to the equation (1). In practice, the average grain distance of WC can be calculated as follows:

$$\lambda_{WC} = \frac{2}{3} d_{WC}\left(\frac{100-(P_E/100)\cdot f_E}{100-f_E-f_{Co}} - 1\right) \quad (2)$$

wherein $\lambda_{WC}$ is the average grain distance of WC in infiltration portions (μm)

$d_{WC}$ is the grain size of WC (μm), $f_E$ is the amount of a conductive component (vol %), $f_{Co}$ is the content of Co (vol %), and $P_E$ is percent preliminary blending (vol %).

Infiltration portions are portions remaining except portions island-shaped texture, i.e., portions comprising a matrix composed of a highly conductive component, and a skeleton composed of an arc-proof component having a grain size of no more than 3 micrometers. Examples of contact materials of the embodiment described above will be described. A method of obtaining and evaluating data and the evaluation conditions are the same as described in Examples A.

Contact under Test

The material from which the contacts under test are produced and the corresponding data are shown in Table 2.

As shown in Table 2, the composition of conductive components in an Ag—Cu—WC—Co alloy was 69 vol % Ag—Cu (an eutectic of Ag and Cu) (except Examples B21 through B24, and Comparative Examples B14 and B15). The amount of the conductive components, i.e., Ag+Cu was varied in the range of 20 to 70 wt %, and the percentage of Ag based on the total amount of Ag and Cu [Ag/(Ag+Cu)×100] was varied in the range of 0 to 100 wt %. The content of Co was varied in the range of 0 to 7 wt %, and the grain size of WC was varied in the range of 0.3 to 5 micrometers. The average grain size of WC is varied as shown in the equation (2) described above by adjusting the amount of the conductive components, the grain size of WC and percent preliminary blending (the proportion of the conductive components introduced by preliminary blending based on the total amount of the conductive components in the contacts).

Examples are mentioned wherein only one parameter selected from the amount of the conductive components, the grain size of WC, the content of Co and percent preliminary blending is varied to change the average grain distance of WC.

EXAMPLES B1 AND B2 AND COMPARATIVE EXAMPLES B1 AND B2

Only the amount of conductive components in contacts was varied and the characteristics of the contacts were examined. When the amount of the conductive components is from 25 to 40% by volume (Examples B1 and B2), the average grain distance of WC is proper, their interruption characteristic is good. Further, their chopping characteristic is good because the amount of the conductive components is relatively small. On the contrary, if the amount of the conductive component is more than 55% by volume (Comparative Examples B1 and B2), the average grain distance of WC is larger, their interruption performance is reduced. Further, their chopping characteristic is reduced because the amount of the conductive components is excessively large.

EXAMPLES B3 AND B4 AND COMPARATIVE EXAMPLES B3 AND B4

Only the grain size of WC in contacts was varied and the characteristics of the contacts were examined. When the grain size of WC is from 0.3 to 0.8 micrometers (Examples B3 and B4), the average grain distance of WC is proper and their interruption characteristic is good. Further, their chopping characteristic is good because the amount of the conductive components is relatively small. On the contrary, if the grain size of WC is from 1.5 to 3.0 micrometers (Comparative Examples B3 and B4), their chopping characteristic is within acceptable range because the amount of the conductive components does not vary. However, the average grain distance of WC is larger and their interruption performance is reduced.

EXAMPLES B5, B6 AND B7 AND COMPARATIVE EXAMPLES B5 AND B6

Only the content of Co in contacts was varied and the characteristics of the contacts were examined. Because the change in the content of WC is small, the change in the average grain distance of WC due to the change in the content of Co is slight, and their interruption performance is good in all of Examples and Comparative Examples. When the content of Co is no more than 1.0% by volume (Examples B5, B6 and B7), their chopping characteristic is good because the content of Co is sufficiently small, whereas in the content of Co of more than 1.0% by volume (Comparative Examples B5 and B6) their chopping characteristic is reduced.

EXAMPLES B8, B9 AND B10 AND COMPARATIVE EXAMPLES B7 AND B8

The total amount of conductive components was kept constant at 25% by volume, only the percent preliminary blending was varied and the characteristics of contacts were examined. When the percent preliminary blending is no more than 40% by volume (Examples B8, B9 and B10), the average grain distance of WC is proper and their interruption characteristic is good. Further, their chopping characteristic is good because the amount of the conductive components is relatively small. On the contrary, if the percent preliminary blending is more than 50% by volume (Comparative Examples B7 and B8), their chopping characteristic does not vary because the amount of the conductive components does not vary. However, the average grain distance of WC is smaller and their interruption performance is reduced.

EXAMPLES B11 AND B12 AND COMPARATIVE EXAMPLES B9 AND B10

The total amount of conductive components was kept constant at 65% by volume and only the percent preliminary blending was varied, and the characteristics of contacts were examined. When the percent preliminary blending is more than 55% by volume (Examples B11 and B12), the average grain distance is proper and their interruption characteristic is good. Further, their chopping characteristic is good because the amount of the conductive components is relatively small. On the contrary, if the percent preliminary blending is less than 40% by volume (Comparative Examples B9 and B10), their chopping characteristic does not vary because the amount of the conductive components does not vary. However, the average grain distance of WC is larger and their interruption performance is reduced.

As can be seen from Examples B1 through B12 and Comparative Examples B1 through B10 described above, satisfactory chopping characteristic can be obtained provided that the total amount of the conductive components is no more than 40% by volume, the grain size of WC is no more than 3 micrometers and the content of Co is no more than 1% by volume. In order to obtain good interruption performance in addition to chopping characteristic, it is necessary that the average grain distance of WC be from 0.1 to 0.5 micrometers and the relative density of the contacts be at least 90% by volume.

While the average grain distance of WC is controlled by any one of parameters in the right side of the equation (2) in Example B1 through B12 and Comparative Examples B1 through B10 described above, the change of at least 2 parameters broadens the ranges the amount of the conductive components and the ranges of the grain size of WC capable of providing the average grain distance of WC of from 0.1 to 0.5 micrometers. In the following Examples and Comparative Examples, the amount of the conductive components, the grain size of WC and percent preliminary blending were changed.

EXAMPLES B13 THROUGH B16 AND COMPARATIVE EXAMPLES B11 AND B12

The amount of conductive components in contacts was varied, at the same time, their percent preliminary blending was varied and the characteristics of the contacts having an average grain distance of WC of a level nearest 0.3 micrometers were examined. When the amount of the conductive components is from 25 to 65% by volume (Examples B13 through B16), the average grain distance of WC is proper and their interruption characteristic is good. Further, their chopping characteristic is good because the amount of the conductive components is relatively small. When the amount of the conductive components is less than 20% by volume (Comparative Example B11), the conductivity of the contact is insufficient and therefore its interruption characteristic is reduced. When the amount of the conductive components is larger than 65% by volume (Comparative Example B12), the amount of the conductive components is excess and therefore its chopping performance is reduced.

EXAMPLES B17 THROUGH B20 AND COMPARATIVE EXAMPLE B13

The grain size of WC in contacts was varied, at the same time, the percent preliminary blending was varied and the characteristics of the contacts having an average grain distance of WC of a level nearest 0.3 micrometers were examined. When the grain size of WC is no more than 3 micrometers (Examples B17 through B20), the average grain distance of WC is proper and their interruption characteristic is good. Further, their chopping characteristic is good because the amount of the conductive components is relatively small. When the grain size of WC exceeds 3 micrometers (Comparative Example 13), the average grain distance of WC is larger even if the percent preliminary blending is increased. Further, the % by volume of WC in infiltration portions is increased due to higher percent of preliminary blending, and therefore closed pores occur to reduce the relative density. Accordingly, its interruption performance is greatly reduced.

While Examples B1 through B20 and Comparative Examples B1 through B13 demonstrated the cases wherein the conductive components were 69 vol % Ag—Cu (an eutectic of Ag and Cu), good chopping characteristic and satisfactory interruption characteristic can be obtained provided that Ag in the conductive components is at least 40% by volume as described in the following Examples (Examples B21 through B24 and Comparative Examples B14 and B15).

While Examples B1 through B20 illustrated contacts wherein Co was used as the sintering aid, other iron family elements can be used. The same results are obtained when Fe or Ni is used in place of Co (Examples B25 and B26).

TABLE 2

| | Composition (vol %) | | | | | | Grain Size of WC (μm) | Percent Preliminary Blending (vol %) | % by Volume of Infiltration Portions (vol %) | % by Volume of WC in Infiltration Portions (vol %) | Average Grain Distance (μm) | Relating Density (vol %) | Chopping Characteristic | Interruption Characteristic |
|---|---|---|---|---|---|---|---|---|---|---|---|---|---|---|
| | Conductive Component | | | | Arc-proof Component WC | Auxiliary Component Co | | | | | | | | |
| | Ag | Cu | Ag + Cu | Ag/(Ag + Cu) × 100 | | | | | | | | | | |
| Exam. B1 | 17.3 | 7.9 | 25.2 | 68.5 | 73.8 | 1.0 | 0.8 | 0.0 | 100.0 | 73.8 | 0.189 | 95 | 0.7 | good |
| Exam. B2 | 27.9 | 12.4 | 40.3 | 69.2 | 58.7 | 1.0 | 0.8 | 0.0 | 100.0 | 58.7 | 0.375 | 99 | 0.8 | good |
| Comp. Exam. B1 | 37.8 | 17.3 | 55.1 | 68.6 | 43.9 | 1.0 | 0.8 | 0.0 | 100.0 | 43.9 | 0.682 | 99 | 1.1 | poor |
| Comp. Exam. B2 | 48.4 | 21.8 | 70.2 | 68.9 | 28.8 | 1.0 | 0.8 | 0.0 | 100.0 | 28.8 | 1.319 | 99 | 2.0 | poor |
| Exam. B3 | 27.6 | 12.4 | 40.0 | 69.1 | 59.0 | 1.0 | 0.3 | 0.0 | 100.0 | 59.0 | 0.139 | 98 | 0.8 | good |
| Exam. B4 | 27.7 | 12.5 | 40.2 | 69.0 | 58.8 | 1.0 | 0.8 | 0.0 | 100.0 | 58.8 | 0.374 | 98 | 0.8 | good |
| Comp. Exam. B3 | 27.6 | 12.7 | 40.3 | 68.5 | 58.7 | 1.0 | 1.5 | 0.0 | 100.0 | 58.7 | 0.704 | 98 | 1.3 | poor |
| Comp. Exam. B4 | 27.4 | 12.7 | 40.1 | 68.4 | 58.9 | 1.0 | 3.0 | 0.0 | 100.0 | 58.9 | 1.396 | 98 | 1.6 | poor |
| Exam. B5 | 17.3 | 8.0 | 25.3 | 68.3 | 74.6 | 0.1 | 0.8 | 0.0 | 100.0 | 74.6 | 0.182 | 95 | 0.9 | good |
| Exam. B6 | 17.0 | 7.7 | 24.7 | 69.0 | 74.8 | 0.5 | 0.8 | 0.0 | 100.0 | 74.8 | 0.180 | 97 | 0.7 | good |
| Exam. B7 | 17.1 | 7.8 | 24.9 | 68.6 | 74.1 | 1.0 | 0.8 | 0.0 | 100.0 | 74.1 | 0.186 | 98 | 0.7 | good |
| Comp. Exam. B5 | 16.8 | 7.8 | 24.6 | 68.3 | 72.4 | 3.0 | 0.8 | 0.0 | 100.0 | 72.4 | 0.203 | 99 | 3.0 | good |
| Comp. Exam. B6 | 17.0 | 7.7 | 24.7 | 68.7 | 68.3 | 7.0 | 0.8 | 0.0 | 100.0 | 68.3 | 0.248 | 99 | 5.0 | good |
| Exam. B8 | 17.3 | 7.9 | 25.2 | 68.6 | 73.8 | 1.0 | 0.8 | 0.0 | 100.0 | 73.8 | 0.189 | 98 | 0.8 | good |
| Exam. B9 | 17.5 | 7.9 | 25.4 | 68.9 | 73.6 | 1.0 | 0.8 | 20.2 | 94.9 | 77.6 | 0.154 | 98 | 0.8 | good |
| Exam. B10 | 17.2 | 7.7 | 24.9 | 69.1 | 74.1 | 1.0 | 0.8 | 35.1 | 91.3 | 81.2 | 0.124 | 90 | 0.8 | good |
| Comp. Exam. B7 | 17.3 | 7.7 | 25.0 | 69.2 | 74.0 | 1.0 | 0.8 | 50.0 | 87.5 | 84.6 | 0.097 | 75 | 0.8 | poor |
| Comp. Exam. B8 | 17.1 | 7.7 | 24.8 | 69.1 | 74.2 | 1.0 | 0.8 | 65.0 | 83.9 | 88.5 | 0.070 | 90 | 0.8 | poor |
| Comp. Exam. B9 | 44.9 | 20.0 | 64.9 | 69.2 | 34.1 | 1.0 | 0.8 | 15.5 | 89.9 | 37.9 | 0.873 | 90 | 0.8 | poor |

TABLE 2-continued

| | Composition (vol %) | | | | | | Grain Size of WC (μm) | Percent Preliminary Blending (vol %) | % by Volume of Infiltration Portions (vol %) | % by Volume of WC in Infiltration Portions (vol %) | Average Grain Distance (μm) | Relating Density (vol %) | Chopping Characteristic | Interruption Characteristic |
|---|---|---|---|---|---|---|---|---|---|---|---|---|---|---|
| | Conductive Component | | | | Arc-proof Component WC | Auxiliary Component Co | | | | | | | | |
| | Ag | Cu | Ag + Cu | Ag/(Ag + Cu) × 100 | | | | | | | | | | |
| Comp. Exam. B10 | 45.0 | 20.1 | 65.1 | 69.1 | 33.9 | 1.0 | 0.8 | 50.5 | 67.1 | 50.5 | 0.523 | 90 | 0.8 | poor |
| Exam. B11 | 44.5 | 20.5 | 65.0 | 68.4 | 34.0 | 1.0 | 0.8 | 55.1 | 64.2 | 53.0 | 0.473 | 90 | 0.8 | poor |
| Exam. B12 | 44.4 | 20.3 | 64.7 | 68.7 | 34.3 | 1.0 | 0.8 | 70.2 | 54.6 | 62.8 | 0.315 | 90 | 0.8 | good |
| Comp. Exam. B11 | 14.0 | 6.2 | 20.2 | 69.1 | 78.8 | 1.0 | 0.8 | 0.0 | 100.0 | 78.8 | 0.143 | 90 | 0.7 | poor |
| Exam. B13 | 17.3 | 7.8 | 25.1 | 68.9 | 73.9 | 1.0 | 0.8 | 0.0 | 100.0 | 73.9 | 0.188 | 92 | 0.7 | good |
| Exam. B14 | 27.8 | 12.4 | 40.2 | 69.2 | 58.8 | 1.0 | 0.8 | 20.2 | 91.9 | 64.0 | 0.300 | 97 | 0.8 | good |
| Exam. B15 | 34.4 | 15.5 | 49.9 | 68.9 | 49.1 | 1.0 | 0.8 | 44.9 | 77.6 | 63.3 | 0.310 | 98 | 1.0 | good |
| Exam. B16 | 44.4 | 20.2 | 64.6 | 68.8 | 34.4 | 1.0 | 0.8 | 69.8 | 54.9 | 62.6 | 0.318 | 99 | 1.3 | good |
| Comp. Exam. B12 | 48.5 | 21.7 | 70.2 | 69.1 | 28.8 | 1.0 | 0.8 | 80.3 | 43.6 | 66.0 | 0.275 | 99 | 2.0 | good |
| Exam. B17 | 27.5 | 12.5 | 40.0 | 68.7 | 59.0 | 1.0 | 0.3 | 0.0 | 100.0 | 59.0 | 0.139 | 99 | 1.5 | good |
| Exam. B18 | 27.8 | 12.4 | 40.2 | 69.1 | 58.8 | 1.0 | 0.8 | 20.0 | 92.0 | 63.9 | 0.301 | 99 | 1.3 | good |
| Exam. B19 | 27.7 | 12.7 | 40.4 | 68.5 | 58.6 | 1.0 | 1.5 | 60.0 | 75.8 | 77.3 | 0.293 | 95 | 1.5 | good |
| Exam. B20 | 27.3 | 12.5 | 39.8 | 68.5 | 59.2 | 1.0 | 3.0 | 65.0 | 74.1 | 79.9 | 0.504 | 90 | 1.8 | good |
| Comp. Exam. B13 | 27.5 | 12.6 | 40.1 | 68.7 | 58.9 | 1.0 | 5.0 | 80.0 | 67.9 | 86.7 | 0.510 | 85 | 4.0 | poor |
| Exam. B21 | 25.0 | 0.0 | 25.0 | 100.0 | 74.0 | 1.0 | 0.8 | 0.0 | 100.0 | 74.0 | 0.187 | 98 | 0.7 | good |
| Exam. B22 | 20.1 | 5.0 | 25.1 | 80.2 | 73.9 | 1.0 | 0.8 | 0.0 | 100.0 | 73.9 | 0.188 | 98 | 0.7 | good |
| Exam. B23 | 17.0 | 7.8 | 24.8 | 68.7 | 74.2 | 1.0 | 0.8 | 0.0 | 100.0 | 74.2 | 0.185 | 98 | 0.9 | good |
| Exam. B24 | 10.0 | 14.9 | 24.9 | 40.3 | 74.1 | 1.0 | 0.8 | 0.0 | 100.0 | 74.1 | 0.186 | 98 | 1.8 | good |
| Comp. Exam. B14 | 5.0 | 19.7 | 24.7 | 20.2 | 74.3 | 1.0 | 0.8 | 0.0 | 100.0 | 74.3 | 0.184 | 98 | 2.5 | good |
| Comp. Exam. B15 | 0.0 | 25.1 | 25.1 | 0.0 | 73.9 | 1.0 | 0.8 | 0.0 | 100.0 | 73.9 | 0.188 | 98 | 5.0 | good |
| Exam. B25 | 34.5 | 15.8 | 50.3 | 68.6 | 48.7 | 1.0 (Fe) | 0.8 | 50.2 | 100.0 | 48.7 | 0.285 | 98 | 1.2 | good |
| Exam. B26 | 34.4 | 15.4 | 49.8 | 69.0 | 49.2 | 1.0 (Ni) | 0.8 | 50.4 | 100.0 | 48.7 | 0.279 | 98 | 1.3 | good |

As can be seen from Examples B1 through B26 and Comparative Examples B1 through B15 described above, contact materials for vacuum interrupters having low surge property and excellent large current interruption characteristics can be obtained by observing the following conditions: the conductive component of the contact material is Ag and/or Cu; the percentage of Ag based on the total amount of Ag and Cu [Ag/(Ag+Cu)×100] is at least 40% by volume; the grain size of the arc-proof material WC is no more than 3 micrometers; the content of the auxiliary component (selected from Co, Fe, Ni and combinations thereof) is no more than 1% by volume; the average grain distance of WC in the infiltration portions according to the equation (1) is from 0.1 to 0.5 micrometers; and the relative density of the contact material is at least 90% by volume.

As stated above, according to the present invention, the following effects and advantages can be obtained. Large current interruption characteristic can be improved. Further, wear resistance can be improved at the same time. Accordingly, the present invention can provide vacuum interrupters having much improved stability of both the characteristics described above.

What is claimed is:

1. A contact material for a vacuum interrupter comprising:

(a) from 25 to 65% by volume of a highly conductive component selected from the group consisting of Ag, Cu and combinations thereof;

(b) no more than 1% by volume of an auxiliary component selected from the group consisting of Fe, Co, Ni and combinations thereof; and (c) a remaining percentage by volume of an arc-proof component comprising a carbide of an element selected from the group consisting of Ti, Zr, Hf, V, Nb, Ta, Cr, Mo, W, and combinations thereof; wherein (A) the composition of the contact material is such a composition that the percentage of Ag based on the total amount of the highly conductive component is from 40 to 100% by volume, (B) the texture of said contact material is such a texture that (i) a portion or all of said contact material comprises a matrix composed of the highly conductive component and a skeleton composed of the arc-proof component having a grain size from 0.3 to 3 micrometers and a remaining portion of said contact material comprises only the highly conductive component which forms a coarse island-shaped texture having a grain size of at least 5 micrometers, and (ii) the average grain distance of said arc-proof component in portions except said island-shaped texture portion calculated by equation (1):

$$\lambda_{WC} = \frac{2}{3} \cdot d_{WC}\left(\frac{f_i}{f_{WC}} - 1\right) \quad (1)$$

(where $\lambda_{wc}$ is the average grain distance of wc (μm), $d_{wc}$ is the grain size of WC (λm), $f_i$ is % by volume of portions except the island-shaped texture, and $f_{wc}$ is % by volume of WC) is from 0.1 to 1 micrometers; and (C) the relative density of said contact material is at least 90% by volume.

2. The contact material for the vacuum interrupter according to claim 1 wherein the highly conductive component contains no more than 60% by volume of Cu.

3. The contact material for the vacuum interrupter according to claim 1 wherein the highly conductive by volume of an auxiliary component selected from the group consisting of Fe, Co, Ni and combinations thereof.

* * * * *